United States Patent [19]

Solomon

[11] Patent Number: 5,005,715

[45] Date of Patent: Apr. 9, 1991

[54] ARTICULATED RAILROAD CAR CONNECTOR

[75] Inventor: James E. Solomon, Lithopolis, Ohio

[73] Assignee: Buckeye Steel Castings Company, Columbus, Ohio

[21] Appl. No.: 383,660

[22] Filed: Jul. 24, 1989

Related U.S. Application Data

[63] Continuation-in-part of Ser. No. 126,183, Nov. 27, 1987, Pat. No. 4,949,856.

[51] Int. Cl.[5] ..... B61G 01/02

[52] U.S. Cl. ..... 213/62 A; 213/188

[58] Field of Search ..... 213/62 A, 67 R, 69, 213/75 R, 188

[56] References Cited

U.S. PATENT DOCUMENTS

| | | | |
|---|---|---|---|
| 981,746 | 1/1911 | Brown . | |
| 1,245,260 | 11/1917 | Newell | 213/69 |
| 2,209,229 | 7/1940 | Kjolseth . | |
| 2,240,363 | 4/1941 | Barrows et al. | 213/62 A |
| 2,737,903 | 3/1956 | McCormick . | |
| 3,480,268 | 11/1969 | Fishbaugh . | |
| 3,587,869 | 6/1971 | Atkinson | 213/64 |
| 3,709,376 | 1/1973 | Altherr . | |
| 3,716,146 | 2/1973 | Altherr | 213/69 |
| 4,236,644 | 12/1980 | DePenti . | |
| 4,236,645 | 12/1980 | DePenti . | |
| 4,336,758 | 6/1982 | Radwill . | |
| 4,422,557 | 12/1983 | Altherr . | |
| 4,531,648 | 7/1985 | Paton . | |
| 4,593,829 | 6/1986 | Altherr | 213/188 |
| 4,700,853 | 10/1987 | Altherr et al. . | |

*Primary Examiner*—Joseph F. Peters, Jr.
*Assistant Examiner*—Virna Lissi Mojica
*Attorney, Agent, or Firm*—Allegretti & Witcoff, Ltd.

[57] ABSTRACT

An articulated connector for railroad cars comprises first and second connector members pivotally connected to each other at inner ends through a pin to permit vertical, rotational and horizontal pivoting of the connector members. The connector members have opposed ends proportioned to each welded to a railroad car sill. The articulated connector may be attached to a railroad truck which holds the connector and the ends of both connected cars. Pin bearing block means are carried in the articulated connector and abut the pin. Preferably, slack adjusting wedges are used to urge the pin against the pin bearing block, with the slack adjusting wedge means being laterally positioned in the connector. Side apertures are then provided for access from the exterior to the slack adjusting wedge means. Also, the inner end of the first connector may define a downwardly facing, spherical face which rests on a spherical recess area defined in the second connector inner end, with the connecting pin extending horizontally through the first and second connector member inner ends. By this and other improvements, improved wear resistance can be provided.

14 Claims, 1 Drawing Sheet

FIG. 1
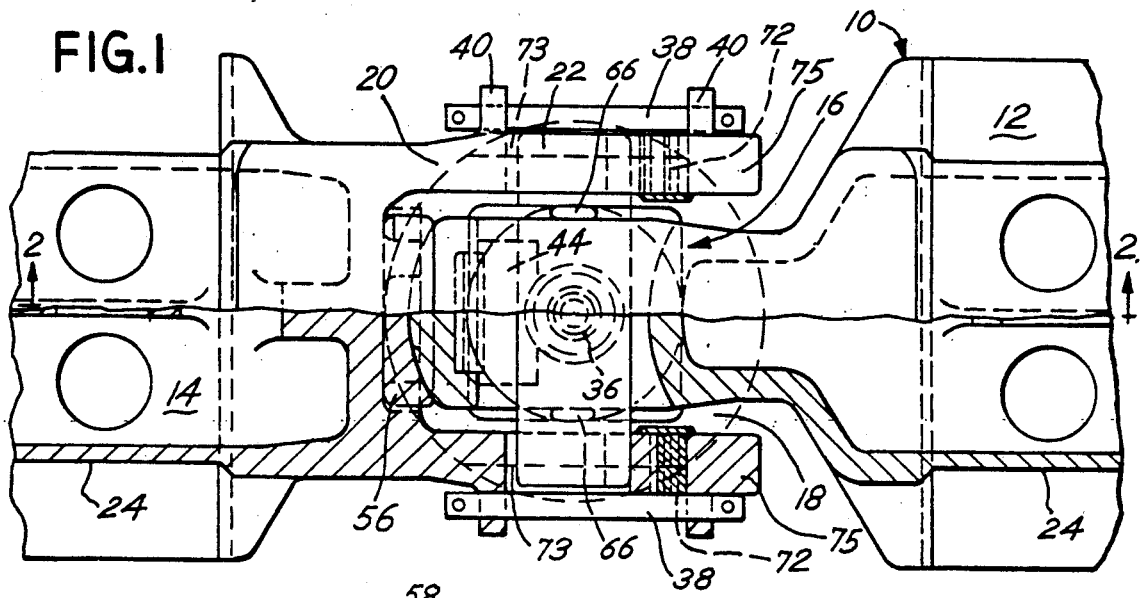
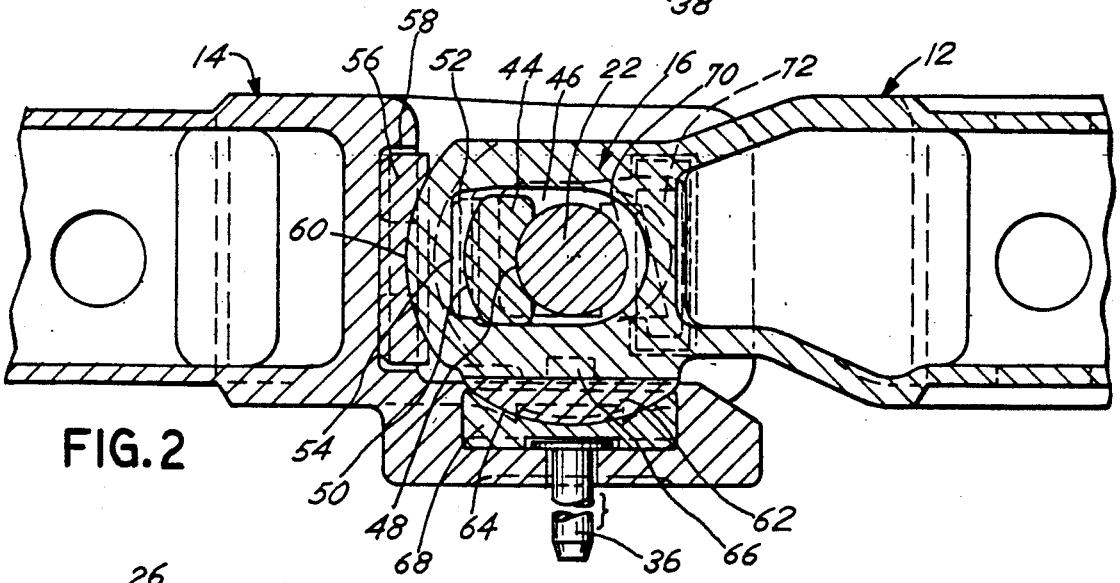
FIG. 2
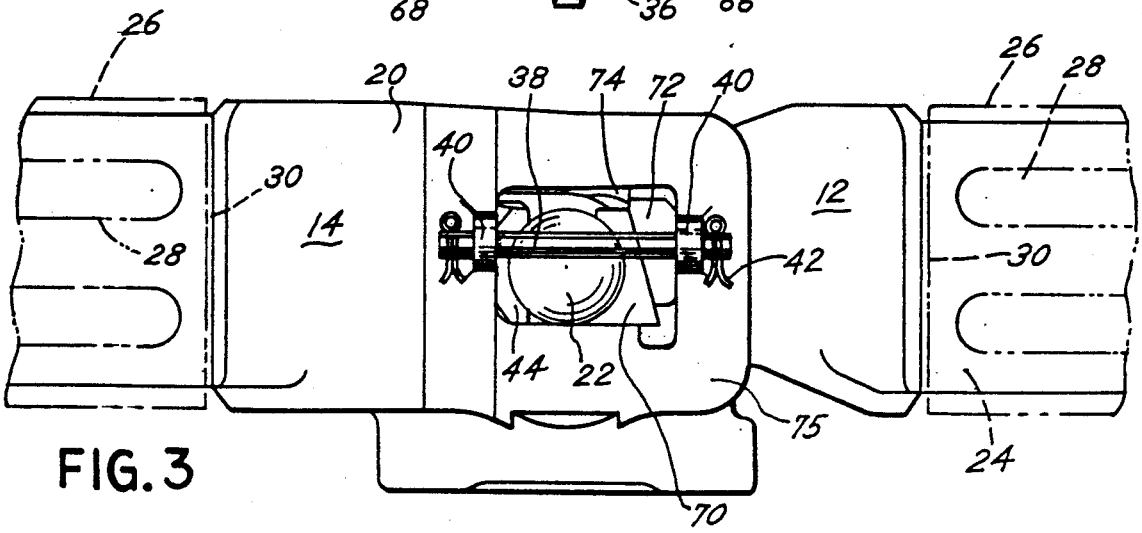
FIG. 3

ARTICULATED RAILROAD CAR CONNECTORCROSS-REFERENCE TO RELATED APPLICATION

This application is a continuation-in-part of the application of James E. Solomon, Ser. No. 126,183, filed Nov. 27, 1987, entitled SLACKLESS DRAWBAR now U.S. Pat. No. 4.949,856.

BACKGROUND OF THE INVENTION

As shown, for example, in Radwill, U.S. Pat. No. 4,336,758, articulated railroad car connectors are a known semi-permanent type of connector between two railroad car ends in which both car ends rest on the same railroad truck. Such articulated connectors find widespread use in the railroad industry.

Disadvantages which have been encountered in articulated railroad car connectors include wear problems on extended use because of the heavy forces encountered in the operation of railroad cars. It is particularly undesirable for the large connector members, which are welded to the railroad car sills and then are connected together in articulated connection, to degrade through wear since their replacement is expensive and difficult.

Additionally, while railroad car connectors of the prior art may utilize slack adjusting wedges (see the Radwill patent cited above, and see also Altherr, U.S. Pat. No. 3,716,146), which wedges are provided to compensate for wear during operation, the wear condition of such parts in prior art connections and the amount of remaining possible slack adjustment is not easily determined in prior designs by casual inspection. Some designs of the prior art permit examination of the slack adjusting wedges through small inspection holes in the connector. If adjustment of the wedges is required, in many designs of the prior art the slack adjustment wedges must be raised, the articulated connector disassembled, and the railroad cars separated enough to put shims behind the follower blocks or slack adjusting wedge assemblies.

The articulated connector of this invention exhibits improved wear resistance characteristics. Particularly, wearing of the connector can be minimized for longer useful life of the connector. Additionally, the slack adjusting wedges in the connector of this invention are readily visible from the exterior, and can be shimmed without having to put one railroad car on jack stands and moving the other railroad car away. Thus, not only does the articulated connector of this invention exhibit longer useful life, but maintenance, repair and adjustment are easier than in the prior art.

DESCRIPTION OF THE INVENTION

In this invention, an articulated connector for railroad cars is provided, comprising first and second connector members pivotally connected to each other at inner ends through a pin to permit vertical, horizontal and rotational motion of the connector members. The connector members have opposed ends proportioned to each welded to a railroad car sill for connection to the cars. Means such as a vertical attachment pin are provided for attaching the articulated connector to a railroad truck.

Pin bearing block means are carried in the articulated connector, the bearing block means abutting the pin which holds the first and second connector members together. Slack adjusting wedge means are provided, urging the pin against the pin bearing block means.

In accordance with this invention, the slack adjusting wedge means are positioned laterally in the articulated connector, thus being accessible from one or the other sides of the articulated connector. A side aperture in one or both sides of the connector is positioned to provide access from the outside to the slack adjusting wedge means. The slack adjusting wedge means are typically provided as a pair of slack adjusting wedges, one of the pair being on each side of the articulated connector, adjacent ends of the connector pin and adjacent a side aperture to permit access.

Preferably, the pin bearing block means described above comprises a first bearing block defining an arcuate recess which abuts the pin, which pin connects the first and second connector members in movable relation with said pin. The first bearing block defines an arcuate face opposed to the arcuate recess, the arcuate face abutting a matching arcuate face of a second bearing block and in slidable relation thereto, to reduce wear. The wear may be particularly reduced if both the first and second bearing blocks are made of hardened steel, harder than the first and second connector members. Also, the first and second bearing blocks preferably abut along a spherical surface, including the arcuate face, to permit movement of the articulated connector in vertical, horizontal and rotational directions about the pin.

Typically, the inner end of the first connector member defines an aperture that contains the pin and the pin bearing block means. Then the inner end of the first connector member is positioned within a recess defined by the inner end of the second connector member. Additionally, the inner end of the first connector member preferably defines a downwardly facing, spherical face which rests on a spherical recess area defined in the recess of the inner end of the second connector member. To facilitate this, the pin which connects the first and second connector members preferably extends horizontally through the first and second connector member inner ends, rather than vertically. Thus, the above-described spherical face, resting on the spherical recess, can be of a substantially larger surface area for supporting vertical loads between the first and second connector members. Because of such increased surface area, compared with articulated connectors of the prior art, wear in this area can be reduced.

Accordingly, an articulated connector which exhibits improved wear characteristics, and in which the slack adjusting wedges are more easily adjusted and maintained, is provided.

DESCRIPTION OF THE DRAWINGS

In the drawings,

FIG. 1 is a plan view of an articulated connector in accordance with this invention;

FIG. 2 is a longitudinal sectional view taken along line 2—2 of FIG. 1; and FIG. 3 is a side elevational view of the articulated connector of FIGS. 1 and 2.

DESCRIPTION OF SPECIFIC EMBODIMENT

Referring to the drawings, articulated connector 10 comprises interconnecting first and second connector members 12, 14. Connector member 12 defines an inner end 16, which fits within a recess 18 defined by inner end 20 of second connector member 14. Pin 22 extends through apertures defined in the respective inner ends 16, 20 in a relatively loose-fitting manner to permit not only vertical pivoting of the respective first and second connector members about pin 22, but also at least a degree of horizontal and rotational pivoting of the respective connector members 12, 14, to permit a certain degree of free motion of the respective railroad cars connected by articulated connector 10.

The ends 24 of the respective first and second connector members 12, 14 may be proportioned in conventional manner to be welded to the respective sills of adjoining railroad cars to provide the desired connection between the two cars.

As shown in FIG. 3, opposed ends 24 of the respective first and second connector members are welded to a sill 26 of respective railroad cars to be connected. The lines of welding may include lines 28 at the edges of open welding slots of sill 26. Also, an inner transverse welding line 30 may be provided.

Additionally, vertical connector pin 36 is provided to fit in a corresponding recess of a railroad truck, upon which articulated connector 10 and the adjacent railroad car ends rest.

Rods 38 are provided to laterally retain pin 22 and to hold it in position. It can be seen that rods 38 are held in apertured projections 40, which project outwardly from the inner end 20 of second connector member 14. Rods 38 are retained in position by cotter pins 42.

First bearing block 44 is provided within aperture 46 of inner end 16 of first connector member 12. First bearing block 44 may be made of hardened steel and is shown to define a cylindrical face 48 which slidably abuts cylindrical pin 22 to slide with respect to pin 22 when first connector member 12 rotates vertically about pin 22.

First bearing block 44 also defines a spherical face 50 on a side opposed to face 48. Spherical face 50 of first bearing block 44 abuts and presses against a spherical face of second bearing block 52 so that both rotational and horizontal motion may take place between the first and second bearing blocks 44, 52. Bearing block 52, in turn, rests against inner surface 54 of aperture 46 within first connector member 12.

Both of bearing blocks 44, 52 are made of hardened steel to minimize the substantial wear that would otherwise take place along inner face 50. Particularly, bearing blocks 44, 52 are typically harder than the material of first and second connector members 12, 14.

Hardened plate 56 rests within a recess 58 of second connector member 14, as shown in FIG. 2, and defines a spherical recess 60 which accommodates the spherical innermost end surface of first connector member 12. Increased surface bearing area is provided by the structures of this invention, when compared with prior art structures, for reduction of pressures per unit area during railroad car buff conditions and consequent reduction of wear.

It will be noted that pin 22 is horizontally positioned, rather than vertically positioned as in many prior art articulated connectors. Because of this, it becomes possible for the inner end 16 of first connector member 12 to rest upon a downwardly facing plate 62, having a lower surface 64 defining a spherical section. Plate 62 defines two upper ribs 66 which form a recess to retain inner end 16 of first connector member 12, shown in FIG. 1 and FIG. 2, so that plate 62 is laterally fixed in its relation with inner end 16.

Spherical face 64 of plate 62 rests against a spherical recess of pressure plate 68, carried by second connector member 14, receiving all of the weight of connector member 12 and permitting horizontal, rotational and lateral pivoting motion between plate 62 and pressure plate 68 along spherical face 64 as the respective first and second connector members pivot with respect to each other.

Because of the horizontal positioning of pin 22, the surface area of spherical face 64 may be larger than in corresponding structures of the prior art, so that the load per square inch along spherical face 64 may be relatively reduced. This results in reduction of wear in the area of spherical face 64, especially when plate 62 and pressure plate 68 are made of hardened steel.

Slack adjusting wedge means 70, 72 are positioned within apertures 73 of inner end 20 of the second connector member 14. Specifically, a pair of slack adjusting wedges 70, 72 are provided, bearing in conventional manner against pin 22, with each of the pair of slack adjusting wedges 70, 72 being laterally positioned near an end of pin 22 so that access may be obtained to the respective wedges through side openings 74 of apertures 73, which are defined in the sidewalls 75 of inner end 20 of the second connector member 14, as particularly shown in FIGS. 1 and 3. Thus, access may be obtained to each of the sets of slack adjusting wedges 70, 72, one on each side, through the respective openings 74 found on each side. Specifically, FIG. 3 depicts each side of the articulated connector 10 of this invention, which sides are identical.

Slack adjusting wedges 70, 72 function in conventional manner by gravity to keep pin 22 pressed against first bearing block 44. Wedge 72 urges wedge 70 by gravitational pressure into engagement with pin 22 to accomplish this. It can be seen also that wedge 70 serves as a bearing against horizontal pin 22.

The above has been offered for illustrative purposes only and is not intended to limit the scope of the invention of this application which is as defined in the claims below.

That which is claimed is:

1. An articulated connector for railroad cars, which comprises:

first and second connector members pivotably connected to each other at inner ends with a pin to permit vertical, rotational and horizontal pivoting of said connector members, said connector members having opposed ends proportioned to each be welded to a railroad car sill, and means for attaching said articulated connector to a railroad truck; pin bearing block means carried in said articulated connector and abutting said pin; slack adjusting wedge means urging said pin against the pin bearing block means, said slack adjusting wedge means being laterally positioned in said connector; and side aperture means in said connector positioned to provide access from the exterior to the slack adjusting wedge means; in which the inner end of the first connector member defines a downwardly facing, spherical face which rests on a spherical recess area defined in a recess of the inner end of the second connector member, said pin extending horizontally through first and second connector member inner ends, whereby said spherical face presses with relatively large surface area against the spherical recess area to provide a load-bearing sliding surface of relatively reduced pressure per unit area.

2. The articulated connector of claim 1 in which said pin bearing block means comprises a first bearing block defining an arcuate recess which receives said drawbar pin in movable relation therewith, said first bearing block defining an arcuate face opposed to said recess, said arcuate face abutting a matching arcuate face of a second bearing block, in rotationally slidable relation thereto, to reduce wear.

3. The articulated connector of claim 2 in which said first and second bearing blocks abut along a spherical surface.

4. The articulated connector of claim 3 in which said first and second bearing blocks are made of a harder metal than said connector members.

5. The articulated connector of claim 1 in which the inner end of the first connector member defines an aperture that contains said pin and said pin bearing block means.

6. The articulated connector of claim 5 in which said inner end of the first connector member is positioned within a recess defined by the inner end of the second connector member.

7. An articulated connector for railroad cars, which comprises:

first and second connector members pivotally connected to each other at inner ends through a single horizontal pin to permit vertical, rotational and horizontal pivoting of said connector members, said connector members having opposed ends proportioned to each welded to a railroad car sill, and means for attaching said articulated connector to a railroad truck; pin bearing block means carried in said articulated connector and abutting said pin; the inner end of the first connector member defining an aperture that contains said pin and pin bearing block means, the inner end of the first connector member being positioned within a recess defined by the inner end of the second connector member, the inner end of the first connector member defining a downwardly facing, spherical face which rests on a spherical recess area defined in the recess of the inner end of the second connector member.

8. An articulated connector for railroad cars, which comprises:

first and second connector members pivotably connected to each other at inner ends with a single pin to permit vertical, rotational, and horizontal pivoting of said connector members, said connector members having opposed ends proportioned to each be welded to a railroad car sill, and means for attaching said articulated connector to a railroad truck; pin bearing block means carried in said articulated connector and abutting said pin; said pin bearing block means comprising a first bearing flock defining an arcuate recess which receives said pin in movable relation therewith, said first bearing block defining a spherical face opposed to said recess, a second, separate bearing block having a matching spherical face abutting the opposed spherical face of the first bearing block, said first and second bearing blocks being in slidable relation to each other to reduce wear; the inner end of the first connector defining an aperture that contains said pin and said pin bearing block means.

9. The articulated connector of claim 8 in which said inner end of the first connector member is positioned within a recess defined by the inner end of the second connector member, the inner end of said first connector member defining a downwardly facing, spherical face which rests on a spherical recess area defined in the recess of the inner end of the second connector member, said pin extending horizontally through first and second connector member inner ends.

10. The articulated connector of claim 8 in which said first and second bearing blocks are made of a harder metal than said connector members.

11. The articulated connector of claim 10 in which said inner end of the first connector member is positioned within a recess defined by the inner end of the second connector member.

12. The articulated connector of claim 11 in which the inner end of the first connector member defines a downwardly facing, spherical face which rests on a spherical recess area defined in the recess of the inner end of the second connector member, said pin extending horizontally through first and second connector member inner ends.

13. The articulated connector of claim 12 including slack adjusting wedge means urging said pin against the pin bearing block means, said slack adjusting wedge means being laterally positioned in said connector; and side aperture means in said connector positioned to provide access from the exterior to the slack adjusting wedge means.

14. The articulated connector of claim 8 including slack adjusting wedge means urging said pin against the pin bearing block means, said slack adjusting wedge means being laterally positioned in said connector; and side aperture means in said connector positioned to provide access from the exterior to the slack adjusting wedge means.

* * * * *